US006453645B1

(12) United States Patent
Suokas et al.

(10) Patent No.: US 6,453,645 B1
(45) **Date of Patent: *Sep. 24, 2002**

(54) METHOD AND APPARATUS FOR PACKAGING FLAT ARTICLES

(75) Inventors: Jouni Suokas, Tammela (FI); Kari Heikkilä , Forssa (FI)

(73) Assignee: Jomet Oy, Forssa (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/680,511

(22) Filed: Oct. 6, 2000

Related U.S. Application Data

(63) Continuation of application No. 09/230,163, filed as application No. PCT/FI97/00557 on Sep. 18, 1997, now Pat. No. 6,128,887.

(30) Foreign Application Priority Data

Sep. 27, 1996 (FI) ..... 963853

(51) Int. Cl.[7] ..... B65B 35/56; B65G 47/24

(52) U.S. Cl. ..... 53/446; 53/542; 53/544; 198/374; 271/185; 271/186

(58) Field of Search ..... 53/446, 542, 544; 414/621, 788.3, 791.2, 791.3, 791.4; 198/374; 271/185, 181, 3.02, 186

(56) References Cited

U.S. PATENT DOCUMENTS 4,155,133 A * 5/1979 Timson ..... 11/1 R
4,655,663 A * 4/1987 Rosati ..... 414/31
5,669,754 A * 9/1997 Croteau et al. ..... 414/786

* cited by examiner

*Primary Examiner*—Rinaldi I. Rada
*Assistant Examiner*—Christopher Harmon
(74) *Attorney, Agent, or Firm*—Connolly Bove Lodge & Hutz, LLP

(57) ABSTRACT

A method for packaging flat articles in a stack in a package such as a box. In particular, the method is used to stack articles having different thicknesses at different ends in the direction of their plane. A stack portion is gripped by a gripping device and rotated 180° from the direction of an adjacent stack portion.

15 Claims, 5 Drawing Sheets

METHOD AND APPARATUS FOR PACKAGING FLAT ARTICLES

CROSS REFERENCE TO RELATED APPLICATION

This application is a continuation of U.S. patent application Ser. No. 09/230,163 filed Jan. 21, 1999, now U.S. Pat. No. 6,128,887, which is a 371 of PCT/FI97/00557, file Sep. 18, 1997.

The invention relates to a method for packaging flat articles. The invention relates also to a packaging apparatus.

Upon packaging large series of flat articles, they are formed into stacks of suitable size which are moved into the package. In these stacks, the articles are parallel, and the aim is to place them tightly against each other in the direction transverse to their planes. A typical example of articles of this kind is envelopes. The handling and packaging of envelopes is described e.g. in the Finnish Patent No. 94042 and in the Finnish published specification No. 97355 by the applicant.

Some articles have such a structure that the thickness of the article is not constant in the direction of its plane. A good example of such a product is envelopes and bag covers which are filled in from the short end, at which there is a closing flap and possibly also a paper covering the adhesive area on it, whereby the product is clearly thicker at one end. If the closing flap is folded out, it forms the thinnest end of the article. When articles of this kind are packaged with an automatic packaging apparatus, in which the articles run in a continuous stack, such constructional features cause more thickness at one end of the stack, which may hamper space utilisation.

The purpose of the invention is to present an improvement to the above-mentioned prior art. From the continuous stack entering the handling step, the product batch to be packaged is not separated and moved as such into the package, but stack portions smaller than the product batch are separated from it and placed next to each other so that the second stack portions come into a 180° rotated position in relation to the first ones, and the adjacent stack portions so handled constitute the product batch, in which the thicker ends point at opposite directions.

The apparatus of the invention, in turn, is characterized in what will be presented in the characterizing part of the appended claim 7. The apparatus comprises means for separating a stack portion from the continuous stack, a gripper which is suspended in a rotation axle and which effects a rotation of 180° of the stack portions in relation to each other, as well as a product batch forming device in the area of motion of the gripper for arranging the stack portions next to each other.

In respect of the other advantageous embodiments of the invention, reference is made to the dependent claims and the description herein below.

Figure 1:
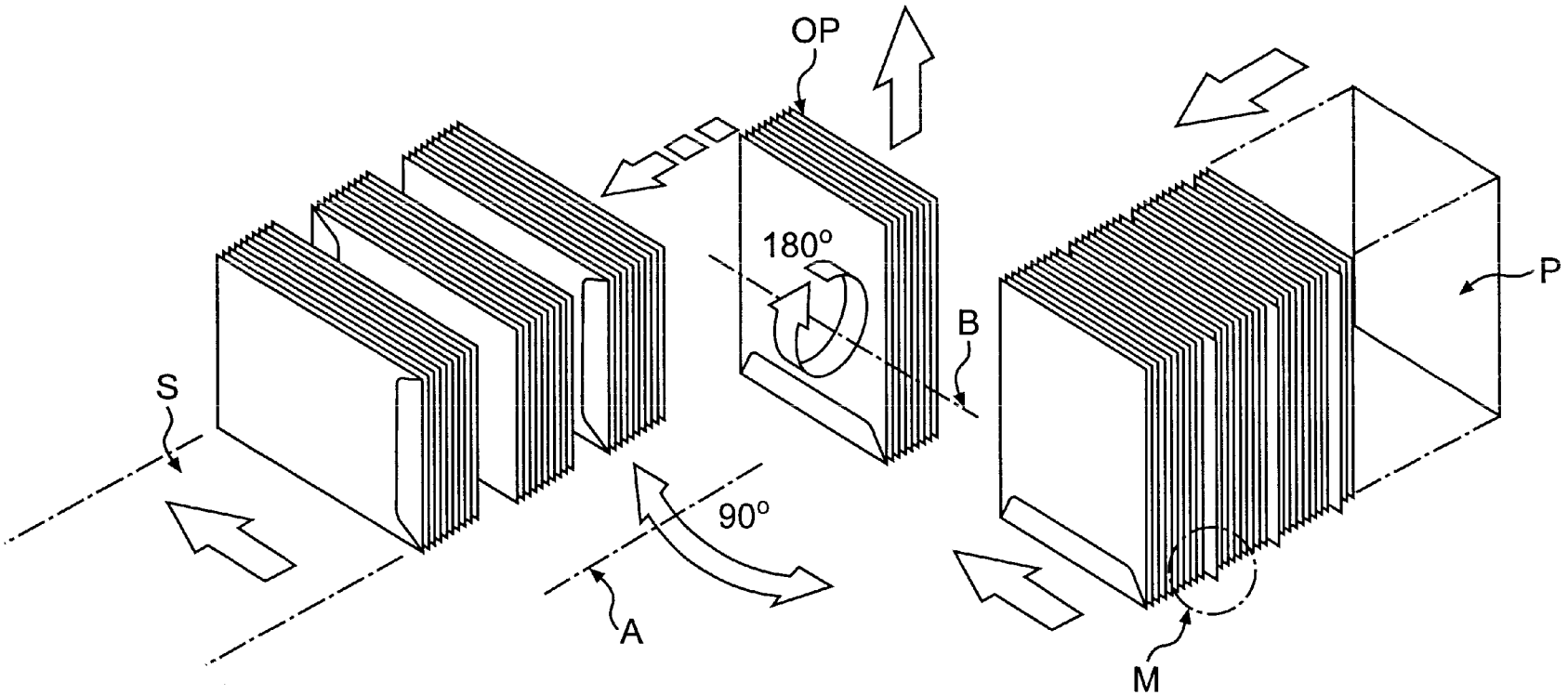
Figure 2:
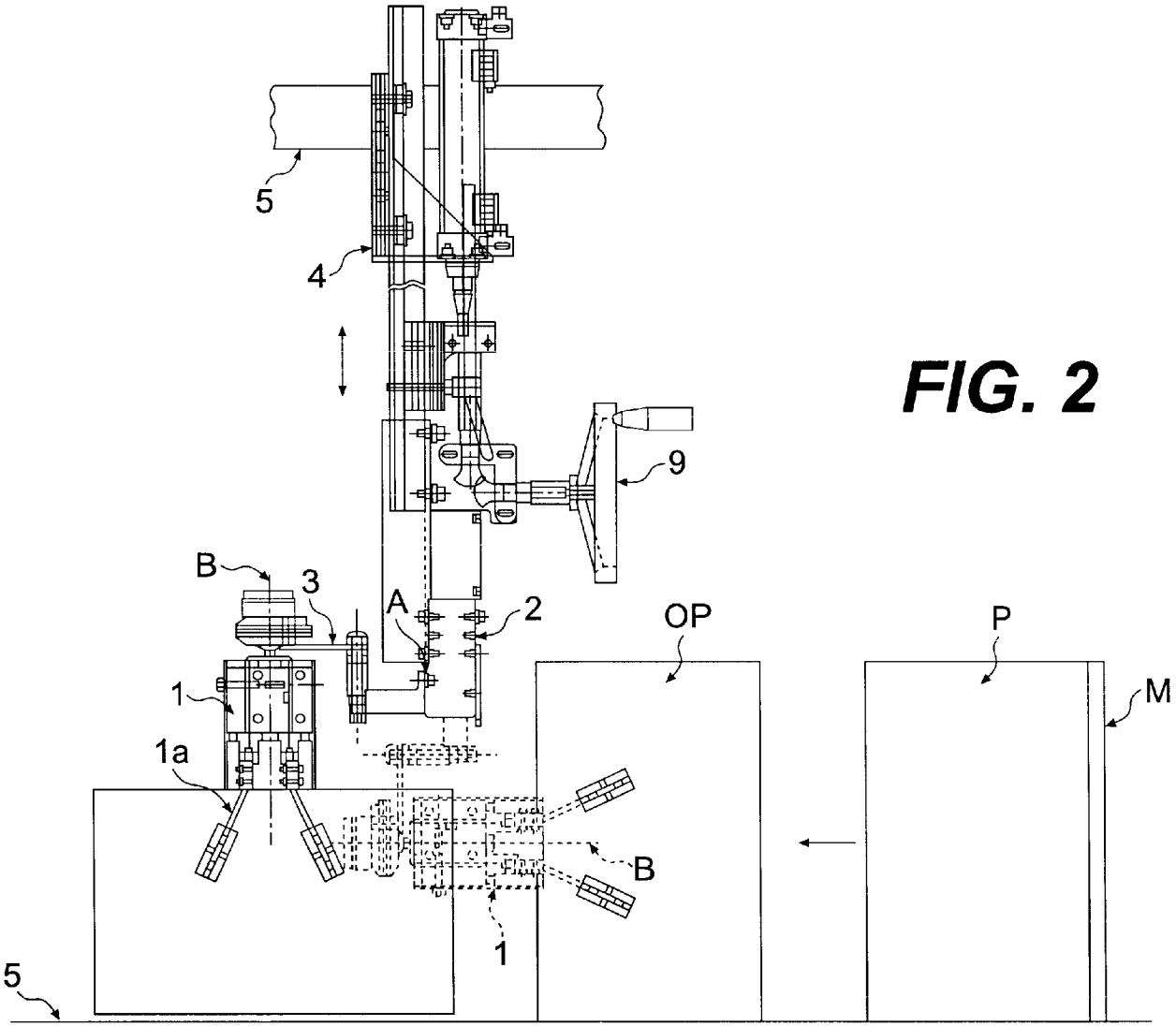
Figure 3:
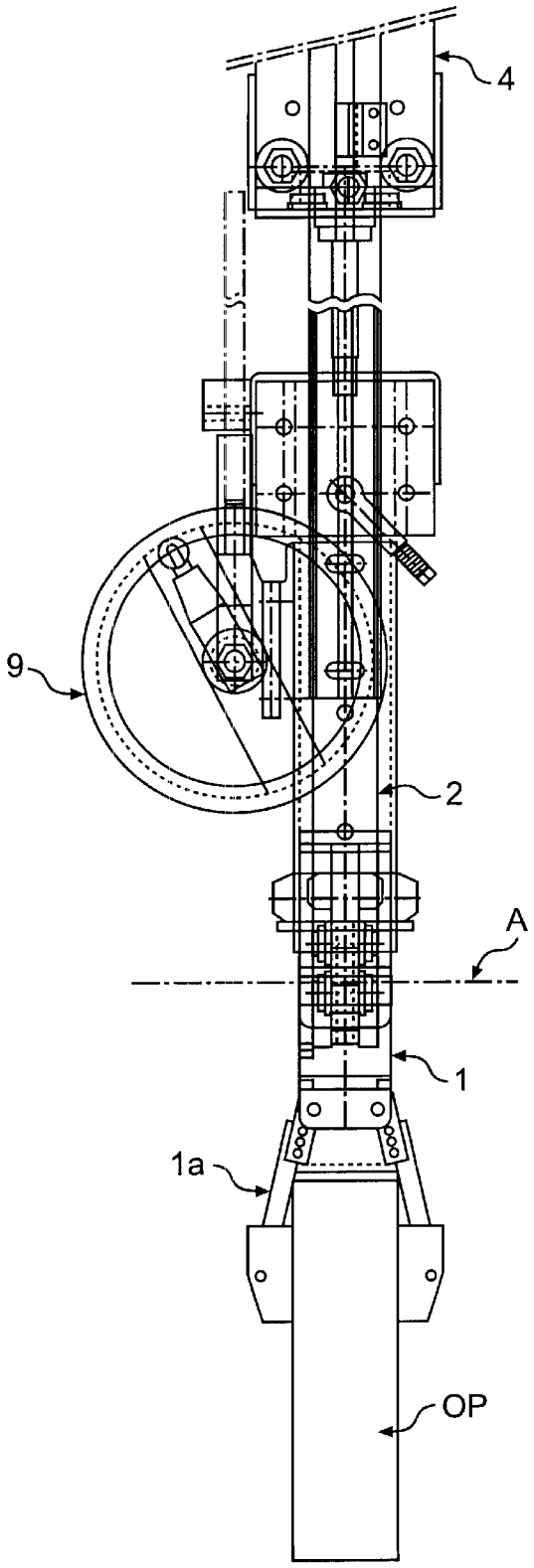
Figure 4:
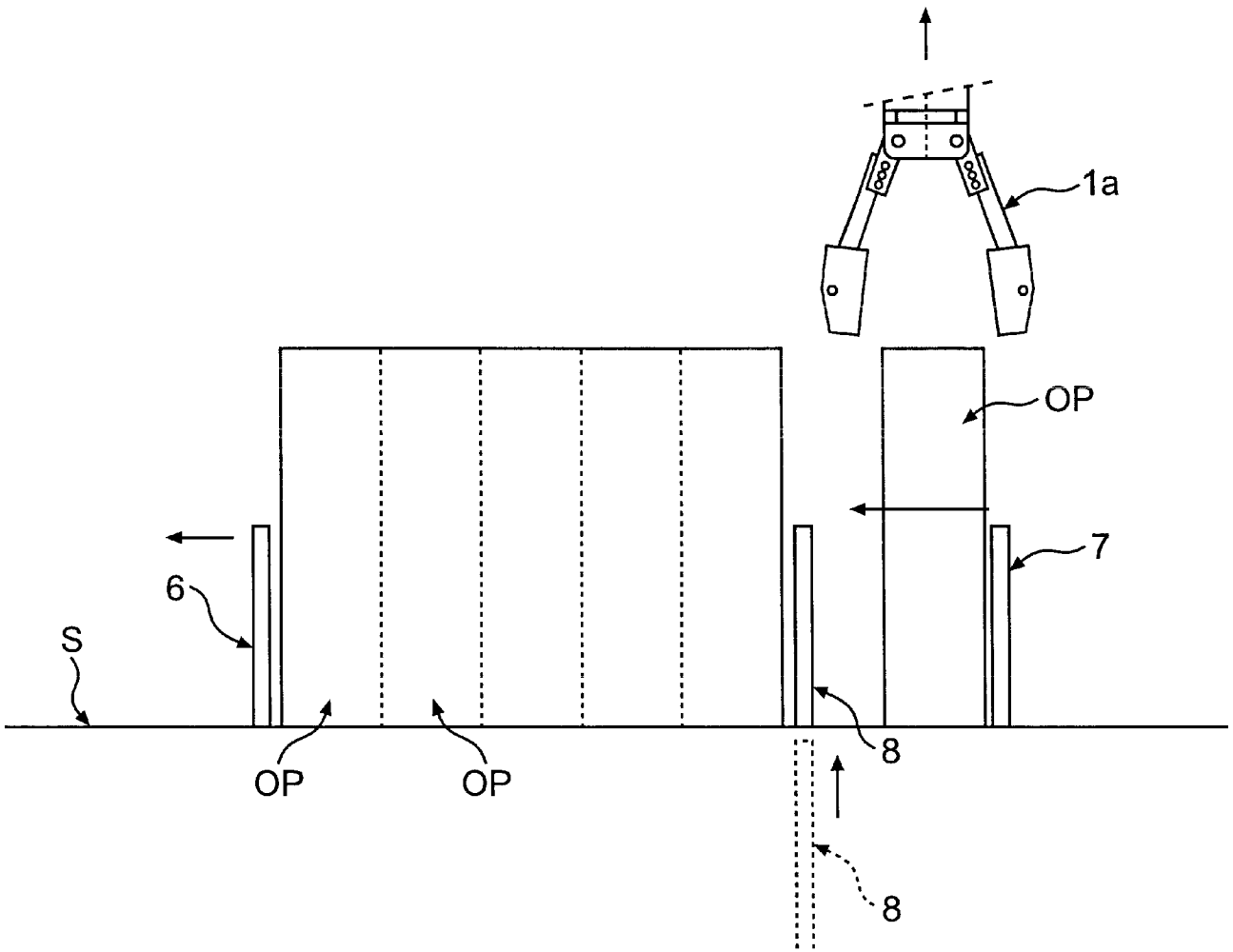
Figure 5:
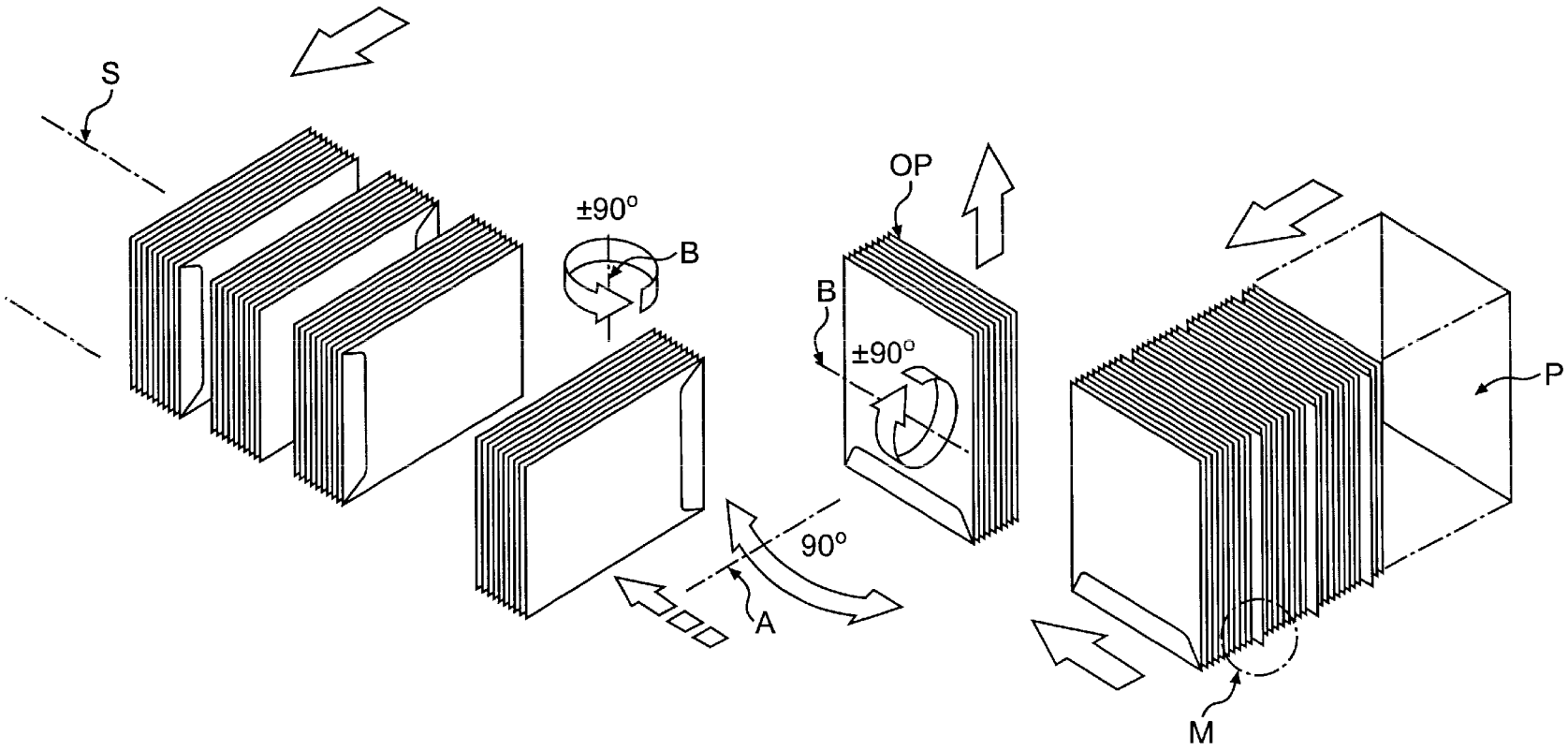

In the following, the invention will be described in more detail with reference to the appended drawings, in which FIG. 1 illustrates the handling of articles, FIG. 2 shows the apparatus of the invention from the front, FIG. 3 shows the apparatus of the invention from the side, FIG. 4 shows the operating principle of the product batch forming device, and FIG. 5 shows an alternative way of handling of the articles to FIG. 1.

The apparatus shown in FIGS. 2 and 3 comprises a gripper 1 comprising fingers la pairwise on both sides of the gripping point. The fingers la are directed in each pair preferably obliquely away from each other, i.e. they make a V opening in the gripping direction. The gripper is suspended at the lower end of a vertical arm 2 to be rotatable around a horizontal axis perpendicular to the longitudinal direction of the arm. In this rotating part, indicated in the figure with the reference number 3, there is still another rotation axis B arranged perpendicular to the said axis A and extending roughly through the gripping space between the pairs of fingers. The arm 2 is arranged to be movable in the vertical direction in a guide 4 (in this case a roller plate, the upper end of the arm being guided between the rollers) which, in turn, is fixed to a horizontal bar 5 fixed to the body of the apparatus. The said gripping and rotating device is placed at a suitable height above the level for handling articles, such as a table for handling envelopes.

Said axes A and B constitute the rotating axes for effecting the suitable turning movements of stack portions held by the gripper 1.

In the starting position, the element 3 has been turned in a receiving position so that the gripper 1, i.e. its fingers la point towards the longitudinal side of the continuous stack P brought along the handling level and coming e.g. from an apparatus for manufacturing envelopes. The levels of the articles are upright in the stack, i.e. their edges lie against the handling level. Thus the receiving space of the gripper opens in a direction perpendicular to the running direction of the stack. From this stack, a stack portion OP is pushed between the fingers of the gripper 1 by a pusher, known as such, placed on the opposite side of the stack, and the fingers 1*a* are turned towards each other, pressing the stack portion between them. In the stack, the stack portions are marked with marker envelopes M left to protrude outwards to utilise them for separation of the stack portions.

At the tips of the fingers of the gripper, there are grip pieces having a gripping surface of a suitable elastic, non-smearing material, and they are articulated to be freely pivotable in the fingers, to be turned e.g. within a certain range of motion, so that they are automatically placed well against both sides of the stack.

In the following, we shall describe a simple operation of moving the stack portion into the product group forming device. Thus, the arm 2 is lifted upwards in the guide 4, wherein the stack portion OP rises in the gripper 1 up from the handling level, and the part 3 is turned 90° around the axis A, and consequently the stack portion OP is simultaneously caused to turn 90° in the direction of the planes of the articles from the original position and is moved in the horizontal direction away from the path of the stack P to the product batch forming device. Thus, the opening space of the gripper faces directly downwards, i.e. the gripper hangs the stack portion downwards. After this, the arm 2 is lowered down so long that the stack portion OP can be delivered to the product batch forming device by releasing the grip of the fingers 1*a*. After this, the gripper 1 returns via a reverse path to its original position to receive a new stack portion OP.

When the transfer of the stack portion OP is effected with an additional rotation, the starting position (receiving position of the gripper) and the final position (delivering position of the gripper) are in principle exactly the same, but during the series of motions between these positions, the stack portion OP has been rotated 180° by rotating the gripper 1 around the axis B. This is conducted preferably at the stage when the stack portion OP is lifted up before the 90° turn to the product batch forming device. Thus, single articles in the stack portion OP are rotated 180° around an axis extending in the direction of their planes, wherein the thicker parts at their ends point to the opposite direction than in the original position.

It is obvious that by alternating said two different series of motions in a suitable way, in the product batch to be formed in the forming device stack portions OP are obtained wherein the thicker ends of the articles point to opposite directions. For example, stack portions OP can be transferred to the product batch forming device alternately with a simple 90° turn and a 90° turn containing a 180° rotation, wherein every other stack portion points to the same direction. The gripper can naturally be programmed to conduct the differing transfer movements also in another order. Further, the 90° rotational motion around the axis extending perpendicularly to the planes of the articles is not necessarily needed, if it is not necessary to change the position of the articles in this direction. In the receiving position, the gripper can also grip the stack portion from above, and the transfer can be effected e.g. as a linear movement to the product batch forming device, naturally by conducting the required number of rotations of the stack portions the other way round.

The turning radius of the gripper 1 around the axis A at the lower end of the arm 2 can be arranged so that the stack portions OP come automatically to the product batch forming device. Thus, the guide 4 does not need to be moved in horizontal direction, but it can be arranged movable in the horizontal bar 5 to a desired position for arranging the transfer paths according to the sizes of the articles. Also, the reciprocating vertical travel length as well as initial height of the arm 2 can be adjustable according to the same criteria. The initial height can be adjusted e.g. manually by changing the length of the arm 2 with a hand wheel 9 provided in the lower part of the arm 2, as shown in FIGS. 2 and 3, for rotating a screw rod which is in engagement with the screw thread in the upper part of the arm.

In the forming device shown in FIG. 4, the product batch to be placed in the package is formed of stack portions OP by arranging the stack portions OP, which were obtained in the above-mentioned way by rotating them in different directions, adjacent to each other so that a product batch with a suitable length is formed in a direction approximately transverse to the direction of the turning motion of the gripper 1. The stack portions brought by the gripper can be arranged next to each other in several ways, of which one advantageous way will be described in the following. The gripper 1 brings down the stack portion OP upright onto the support base of the forming device, i.e. on the forming level S of the product batch, between a transfer guard 7 and a front guard 6 standing on it. The front guard 6 is arranged to be movable in the direction of formation of the product batch and to support the continuously growing product batch in the front, whereas the transfer guard 7 is arranged to perform a short transfer motion. After the stack portion OP is released from the grip of the gripper 1 and the gripper 1 is lifted up, the transfer guard 7 removes the stack portion from this area, to which a new stack portion OP is always brought by the gripper 1. At the same time, the stack pushes the front guard 6 which is placed in front of it and which can be arranged to be movable with a suitable frictional load. When the transfer guard 7 returns to the other side of the receiving area, a holding guard 8 rises simultaneously up from the support level to support the stack portion OP from the back. The holding guard descends always underneath the support level to clear the way when a new stack portion is pushed against the preceding one by the transfer guard 7, whereafter it will rise again to support the grown stack from the back. In this way, the whole stack or product batch is formed of stack portions. Also the transfer guard 7 can be arranged movable back and forth in the vertical direction so that it can be moved to its initial position while being underneath the support base, wherein the stack portion OP can be brought by the gripper even at this stage, and it will rise up first on the other side of the stack portion. The holding guard 8 can be located by the side of the path of the transfer guide 7 e.g. in a short groove in which the position of the holding guard can be adjusted. All guards can be arranged as vertical rods in pairs, for obtaining sufficient support to the product batch.

When the front guard 6 is in its final position, the product batch is finished in the forming device, and it is pushed from the side with a suitable pusher to the packaging stage, wherein solutions known in the art can be used. Here it is possible to use also a second gripper, the product batch being pushed between the jaws of the gripper, and the gripper causes the product batch to slide into the package in a way known from the Finnish published specification No. 97355 by the same applicant. After this, the front guard 6 returns to its initial position close to the transfer guide 7.

With respect to the placement of the different parts of the apparatus, the paths of the articles are arranged so that, seen from above, the continuous stack P is brought in one direction by a conveyor, the transfer path of the gripper is perpendicular to this incoming direction, and product batch formation (direction of motion of the front guard 6) is continued from the delivery point of the gripper 1 in the same direction as the incoming direction of the stack P. The handling of articles according to this is illustrated also in FIG. 1.

FIG. 5 shows an alternative way of product batch formation. The final structure of the product batch on the forming level S is in other respects the same as above, and its formation can be implemented by using the formation device of FIG. 4. The difference is that after gripping the stack portion OP, each stack portion is also rotated around the axis B, either 90° clockwise or 90° counterclockwise, wherein the 180° directional difference can also be obtained for the thickest ends of the stack portions OP. Thus, due to the extent of the rotating motion, the product batch, however, starts to form in a direction perpendicular to the incoming direction of the stack P. This can be useful, if such a solution is required by the placement of different handling devices in the packaging line. It is also possible that the rotating movements around the axis B have different absolute values so that the sum of the directional deviations is 180°. For example, if the first stack portion OP is rotated 45° in one direction and the second stack portion 135° in another direction, their lower edges come to an inclined position compared with the horizontal plane, due to the rotational movement around the axis A. Thus, the product batch forming level S can be inclined in a corresponding manner.

Naturally in the case of FIGS. 1 and 5, the rotational movement achieving the 180° difference can also be exerted after the rotational movement around the axis A or after some other corresponding transfer movement away from the stack P in the direction of the handling level. This is illustrated also in FIG. 5 (axis B in vertical position).

The invention, particularly the design and suspension of the parts of the transfer device, has several modifications. The actuators and automation are known as such, and the different linear and rotational movements are made by pneumatic actuators or electric motors. The invention is not limited solely to the structural solutions and movement paths presented above, but it can be modified within the scope of the inventive idea presented in the appended claims.

What is claimed is:

1. A method for packaging flat articles, the articles having planes and different thicknesses at different ends in the direction of their planes, the method comprising:

providing first and second stack portions each consisting of several articles and having an original direction defined by said ends;

gripping a first stack portion by a gripping device;

rotating said first stack portion by the movement of the gripping device around a rotation axis while being held by said gripping device so that it assumes a second direction, said second direction deviating 180 degrees from the original direction with respect to said rotation axis;

placing said first stack portion so rotated next to a second stack portion gripped by said gripping device but left unrotated around the same rotation axis by means of the gripping device and having a direction that deviates from said second direction of said first stack portion with respect to said rotation axis by 180 degrees, said first stack portion and said second stack portion being included in a product batch to be packaged, wherein the first and second stack portions are transferred by said gripping device next to each other into upright positions onto a product batch forming level; and packaging said product batch.

2. The method according to claim 1, wherein the rotation axis extends parallel to the planes of the articles in order to achieve the second direction.

3. The method according to claim 2, wherein the first stack portion is rotated both around the rotation axis extending parallel to the planes and around an axis extending perpendicularly to the rotation axis parallel to the planes, and the second stack portion, left unrotated around the rotation axis extending parallel to the planes, is rotated around the axis extending perpendicularly to the rotation axis parallel to the planes.

4. The method according to claim 1, wherein the product batch is packaged by causing it to slide by means of a second gripping device into a package.

5. The method according to claim 1, wherein the articles are envelopes or bag covers having closing flaps.

6. A method for packaging flat articles, the articles having planes and different thicknesses at different ends in the direction of their planes, the method comprising:

providing first and second stack portions each consisting of several articles and having an original direction defined by said ends;

gripping a first stack portion by a gripping device;

rotating said first stack portion by the movement of the gripping device around a rotation axis in one direction while being held by said gripping device so that it assumes a second direction, said second direction deviating less than 180 degrees from the original direction with respect to said rotation axis;

placing said first stack portion so rotated next to a second stack portion rotated around the same rotation axis by means of the gripping device in another direction so that the second direction deviates less than 180 degrees from the original direction with respect to said rotation axis and deviates from said second direction of said first stack portion with respect to said rotation axis by 180 degrees, said first stack portion and said second stack portion being included in a product batch to be packaged; and packaging said product batch.

7. The method according to claim 6, wherein the first stack portion is rotated around the rotation axis by means of the gripping device 90 degrees clockwise, and said second stack portion is rotated around the same rotation axis by means of the gripping device 90 degrees couterclockwise.

8. The method according to claim 7, wherein the first and second stack portions are transferred by said gripping device next to each other into upright positions onto a product batch forming level.

9. The method according to claim 8, wherein the product batch is packaged by causing it to slide by means of a second gripping device into a package.

10. The method according to claim 6, wherein the rotation axis extend parallel to the planes of the articles in order to achieve the second direction.

11. The method according to claim 10, wherein the first and second stack portions are rotated both around the rotation axis extending parallel to the planes and around an axis extending perpendicularly to the rotation axis parallel to the planes.

12. The method according to claim 6, wherein the articles are envelopes or bag covers having closing flaps.

13. An apparatus for packaging flat articles, comprising an automatic grouping device for forming product batches from said flat articles and a packaging means for packaging the product batches, said grouping device comprising:

means for providing successive stack portions having each an original direction;

a gripping device arranged to receive said stack portions and being rotatable around a rotation axis;

a product batch forming device in the range of motion of the gripping device for receiving the stack portions from them gripping device and arranged to form a product batch from the successive stack portions;

said gripping device being arranged to rotate stack portions around said rotation axis to change the original directions of the stack portions with respect to said rotation axis, wherein the gripping device is arranged to rotate a first stack portion 90 degrees around said rotation axis and a second stack portion 90 degrees in an opposite direction around the same rotation axis, said gripping device being further arranged together with said product batch forming device to place stack portions whose directions deviate with respect to said rotation axis by 180 degrees, next to each other.

14. The apparatus according to claim 13, wherein the gripping device is rotatable around a second rotation axis perpendicular to said rotation axis.

15. The apparatus according to claim 13, wherein the product batch forming device comprises a front guard and a holding guard arranged to keep the successive stack portions therebetween on a product batch forming level in upright positions.

* * * * *